US005340455A

United States Patent [19]

Kroon et al.

[11] Patent Number: 5,340,455

[45] Date of Patent: Aug. 23, 1994

[54] CATHODIC PROTECTION SYSTEM FOR ABOVE-GROUND STORAGE TANK BOTTOMS AND METHOD OF INSTALLING

[75] Inventors: David H. Kroon, Spring, Tex.; Michael K. Baach, Parma, Ohio

[73] Assignee: Corrpro Companies, Inc., Medina, Ohio

[21] Appl. No.: 7,537

[22] Filed: Jan. 22, 1993

[51] Int. Cl.[5] ..... C23F 13/00

[52] U.S. Cl. ..... 204/196; 204/147

[58] Field of Search ..... 204/196, 147

[56] References Cited

U.S. PATENT DOCUMENTS

| | | | |
|---|---|---|---|
| 3,725,225 | 3/1971 | Sudrabin et al. | 204/196 |
| 3,868,313 | 2/1975 | Gay | 204/196 |
| 4,298,445 | 11/1981 | Warne | 204/196 |
| 4,900,410 | 12/1990 | Bennet et al. | 204/196 |
| 5,062,934 | 11/1991 | Mussinellil | 204/196 |
| 5,065,893 | 11/1991 | Kroon et al. | 220/565 |
| 5,172,584 | 12/1992 | Thomas | 220/565 |
| 5,176,807 | 1/1993 | Kumar | 204/196 |
| 5,185,921 | 2/1993 | Pfaller et al. | 204/196 |

*Primary Examiner*—John Niebling
*Assistant Examiner*—Kishor Mayekar
*Attorney, Agent, or Firm*—Renner, Otto, Boisselle & Sklar

[57] ABSTRACT

The invention relates to a cathodic protection system for above-ground storage tanks having metal bottoms, either new or retrofitted bottoms. A leak containing dielectric safety membrane is spaced a short distance below and extends beneath the tank bottom generally parallel thereto forming a narrow envelope. Compacted electrolytic conductor material is positioned between the membrane and the tank bottom supporting the tank bottom embedding a horizontally disposed cathodic protection anode, the anode being in the form of a matrix, maze or grid of interconnected titanium wires, or wires and ribbons or bars. A reticulate or open dielectric insulator may be embedded in the electrolytic conductor and positioned directly above the anode and such insulator is operable to keep any portion of the anode from contacting the tank bottom and to maintain a generally uniform spacing between the anode and tank bottom. The wires may extend transversely of the bars or ribbon and are spot welded or mechanically connected on uniform centers to such bars or ribbons on diameters or major chords of a circular tank bottom. A low profile connection is provided between the bars or wires and power feeds to a rectifier, and for large tank bottoms a multiplicity of such connections strategically spaced are provided. Similarly, a plurality of reference cells both in location and kind may be provided so there are redundant power feeds and reference cells. The anode is constructed by uncoiling, straightening, bending, arranging and connecting the wires and ribbons on a compacted layer of electrolytic conductor on the liner. After the power feeds and reference cells are attached and routed to the external rectifier or test station, the insulator may be placed above the anode. Further compacted electrolytic material fills the openings in the insulator and the tank bottom is then constructed on the compacted material.

30 Claims, 5 Drawing Sheets

CATHODIC PROTECTION SYSTEM FOR ABOVE-GROUND STORAGE TANK BOTTOMS AND METHOD OF INSTALLING

DISCLOSURE

This invention relates generally as indicated to a cathodic protection system for above ground storage tank bottoms and method of installing the same.

BACKGROUND OF THE INVENTION

Above-ground storage tanks are those which are supported on the ground rather than buffed or supported in elevated position. Such tanks can be of substantial size and volume and may range up to a football field in diameter.

New and rebuilt above-ground storage tanks use an environmental safety secondary containment liner in the form of a plastic membrane. The liner or membrane is usually spaced a short distance beneath the metal bottom which is supported on compacted earth above and below the liner. The membrane is designed to contain leaks to prevent ground contamination.

Unfortunately, because of the dielectric properties of the secondary containment liner, conventional and widely accepted cathodic protection methods such as those using replaceable deep anodes or distributed anodes are no longer applicable. Such systems usually use large anodes which, in any event, would not normally fit in the relatively narrow envelope between the liner and the tank bottom. The dielectric liner effectively blocks the required current flow from such anodes to the tank bottom. Accordingly, to be effective, an anode system has to be placed in the relatively narrow envelope between the liner and the tank bottom.

Many operators have chosen galvanic cathodic protection systems which use zinc or magnesium ribbon anodes. These galvanic anode ribbon systems are typically installed in parallel lengths between the membrane and the tank bottom floor. This method of cathodic protection can be an effective means of tank bottom corrosion control. However, because of the large volume of anode material required fully to protect the tank bottom, these systems have proven to be quite costly.

Also, because most storage tanks use complex and highly sensitive leak detectors, it is important that the compacted medium between the liner and tank bottom not be comprised of hydrocarbons or not be carbonaceous. Experiments have shown that conventional conductive carbonaceous backfills, which are widely used with existing impressed current systems, set off such leak detectors or otherwise render them useless. The backfill must not be an electronic conductor to avoid shorting between the anode and bottom, and yet must be capable of being compacted and supporting uniformly high compressive loads. The backfill material, however, must be an electrolytic or ionic conductor.

It is also important that the anode be generally uniformly spaced from the tank bottom and not touch the bottom. If it touches, a short occurs and the system malfunctions, or if it is not substantially uniformly spaced from the tank bottom a near short may occur resulting in non-uniform distribution of the protective current. The area beneath a large storage tank is hardly accessible, and convenient repairs are virtually impossible. It is, therefore, important to use as anode materials, components which don't themselves substantially corrode, or which don't form current blocking oxidation layers. Further, the anode and the connections to the anode should provide a thin or low profile and should also be such that the system provides a minimal cathodic protection current substantially uniformly to the entire tank bottom.

In applicant's prior U.S. Pat. No. 5,065,893 there is illustrated a tank bottom anode and system constructed as a grid from oxide or precious metal coated titanium bars and ribbons, or in one embodiment mesh strips. To fabricate such grids, the bars, ribbons or strips have to be cut to length and tack welded to each other at points of intersections. While the relatively smaller ribbon can be directed on a relatively large radius of curvature, it can't be bent to go around a comer or on a short radius of curvature and remain flat without being creased. This may adversely affect the exotic passivating coating. Thus, fabrication of a large tank bottom anode requires many steps of cutting and tack welding to create the desired grid or pattern, each, however, creating a potential point of failure. Thus, the grids or patterns available are difficult and costly to fabricate and install correctly. Moreover, the coated titanium or other metal bars, ribbon and mesh strips are quite costly. Because of the cutting and fabricating required, a good portion of the material required becomes scrap. Thus, it would be advantageous to use a less costly material which can more easily be configured into the current distribution grid or maze and which can carry more current.

Another form of tank bottom anode uses a multiplicity of loops and insulated cathodic protection cable, the center of the loops being somewhat vaguely related to the center of the tank. At spaced intervals, each cable has the insulation removed and short section or pigtail of titanium wire is connected thereto, which becomes the anode. This system has a multiplicity of connections, each being a potential point of failure, is difficult, and costly to install, and provides limited grid patterns and current density control. The many free wire ends create both an installation problem and a current distribution problem since much of the current tends to flow through the cut wire ends creating what might be termed a spotty distribution pattern.

Titanium wire has additionally been used in other cathodic protection applications. For example, it has been used as a core in a cannistered anode assembly. The wire extends axially of the tubular galvanized canister and is embedded in coke breeze. At one end, the wire is connected to the anode cable through a special connection. These canistered anodes have been sold under the trademark LIDA.

Another type of titanium wire anode has been marketed by MAGNETO-CHEMIE of Schiedam, Holland. In this type of wire anode, the titanium wire is helically coiled about a current feeding cable and electrically connected to the cable at the ends or at varying centers along the cable. The cable has partial insulation.

U.K. Patent Publication GB 2175609A discloses titanium as one element in a valve metal group from which wires may be made for use in the cathodic protection of steel in steel reinforced concrete. A wire mesh or netting is formed which is used with a main anode layer. The wire mesh serves a double function as being a connection to the main anode, and a back up in the event of failure of the main anode, which is disclosed as a graphite slab mounted on top of a beam. All of the above types of anodes have cost and/or construction limitations which add to or make more difficult the task of designing and installing cathodic protection systems for new or rebuilt above-ground storage tanks.

SUMMARY OF THE INVENTION

Most new above-ground storage tanks have a metal bottom with a leak containing dielectric safety membrane spaced a short distance below, and extending beneath and parallel to the tank bottom forming a relatively narrow envelope. Compacted electrolytic backfill material is positioned between the membrane and the tank bottom supporting the tank bottom. A horizontally disposed cathodic protection anode is positioned between the membrane and the tank bottom, the anode being in the form of a matrix, maze or grid of electrically interconnected coated titanium wires or titanium clad copper wires, and such wires and titanium bars or ribbons. The wires are provided with a mixed metal oxide or noble metal coating. The bars or ribbons may also be coated. In lieu of the preferred titanium, other suitable valve metals may be used such as aluminum, tantalum, zirconium or niobium, and alloys thereof. In one form of the invention a reticulate dielectric insulator may be embedded in the electrolytic backfill and positioned above the wire anode or between the anode and the tank bottom. Such insulator is operable to keep any portion of the anode from contacting the tank bottom and to maintain a generally uniform spacing between the anode and the tank bottom.

In other forms of the invention, the wires may form a matrix or maze. The wires extend transversely of conductor bars and are spot welded or mechanically connected on uniform centers to bars on diameters or major chords of a circular tank bottom. Wires where they cross may also be welded to each other or secured by conductive mechanical fasteners. The wires also may cross the bars as concentric chords, radii, or spirals. A low profile connection may be provided between the bars and rectifier, or directly from the wire to the rectifier and for large tank bottoms, a multiplicity of such connections strategically spaced are provided. Similarly, a plurality of reference cells, both in location and kind, may be provided, so there are redundant power feeds and reference cells.

The anode is constructed by uncoiling, straightening, forming, arranging and connecting the wires and bars on a compacted layer of electrolytic backfill on the liner. After the conductors are attached and routed to the external rectifier, the reticulate or mesh insulator may be placed above the anode. The reference cells may be positioned before or after placement of the insulator and the remainder of the envelope is filled with an electrolytic conductor such as sand, pea gravel, bentonite clay, or other earthen or synthetic material which is compacted and leveled to form a surface on which the tank bottom is constructed. The compacted electrolytic backfill fills the many openings in the insulator to provide paths for current flow. The insulator provides substantially uniform current distribution and spacing of the anode and tank bottom, and importantly, prevents shorting contact of the anode with the tank bottom during or after construction.

It is therefore an object of the invention to provide an easily designed or fabricated cathodic protection system for new or rebuilt above-ground storage tanks which are also easier and less costly to install, resulting in a long life, more reliable system.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

FIG. 26 is a plan illustration of maze-type anodes which may be fabricated for double ring wall tanks;

DETAILED DESCRIPTION OF THE PREFERRED EMBODIMENTS

Figure 1:
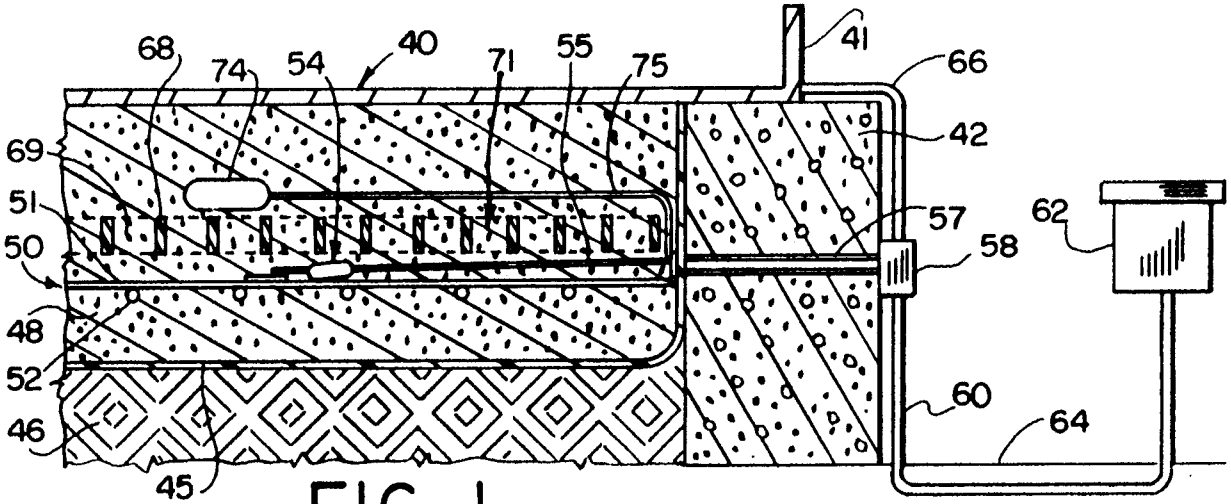
FIG. 1 is a fragmentary vertical section through one form of tank bottom illustrating the ring wall.

Referring initially to FIG. 1, there is illustrated a cathodic protection system for a new tank bottom which is indicated at 40. The metal tank bottom 40 extends inwardly from tank wall 41 which is positioned over reinforced concrete ring wall or footer 42. Extending along the inside of the ring wall, below and parallel to the bottom wall 40, is a secondary containment liner 45 which is in the form of a plastic membrane or sheet. The liner is supported on compacted earth 46 within the ring wall. Such tanks are normally circular and can be very wide in diameter. It is not uncommon for a storage tank to have a diameter approaching that of a football field. However, the vertical distance between the secondary containment liner 45 and the tank bottom 40 is usually a little more than a foot, for example. Thus, the liner forms an envelope with the tank bottom which is significant in horizontal extent or area and yet which is relatively short in height. It is within this narrow envelope that the anode of the cathodic protection system must be constructed and yet be spaced away from the tank bottom.

As seen in FIG. 1, the envelope between the secondary containment liner 45 and the tank bottom 40 is filled with compacted electrolytic backfill indicated at 48. Embedded within the compacted electrolytic backfill is a horizontally extending grid or maze anode 50 which is constructed of valve metal conductor bars or ribbons 51 and transversely extending coated valve metal wires 52 as hereinafter more fully described. In this specification the terms "bars" and "ribbons" are used interchangeably. Such terms are like "wire" and "rod" or "strip" and "sheet". The only difference is one of size with the bar, rod or strip being larger.

The conductor ribbons 50 are provided with a number of power feed connections shown generally at 54, by which power leads 55 are connected to the anode. The power feed leads extend through conduit 57 through the ring wall to junction box 58. The junction box is electrically connected through conduit 60 to rectifier 62 which is above grade 64. The rectifier, conventionally, is connected to a power source, not shown. A ground lead to the tank extends through conduit 66 from the junction box.

Positioned immediately above the anode 50 may be a reticulate or mesh plastic insulator 68, the openings 69 of which in the illustrated embodiment are diamonds or squares approximately 2"×2". The compacted electrolytic backfill fills the openings as indicated at 71. A plurality of reference cells indicated at 74 are provided within the compacted electrolytic backfill, either above or below the anode 50. Such cells are connected through leads 75 through the conduit 57 to terminals in the junction box 58. Compacted electrolytic backfill 48 completely fills the envelope between the secondary containment liner and the tank bottom and affords a working surface on which to construct the tank bottom and which will support the significant compressive loads required.

Figure 3:
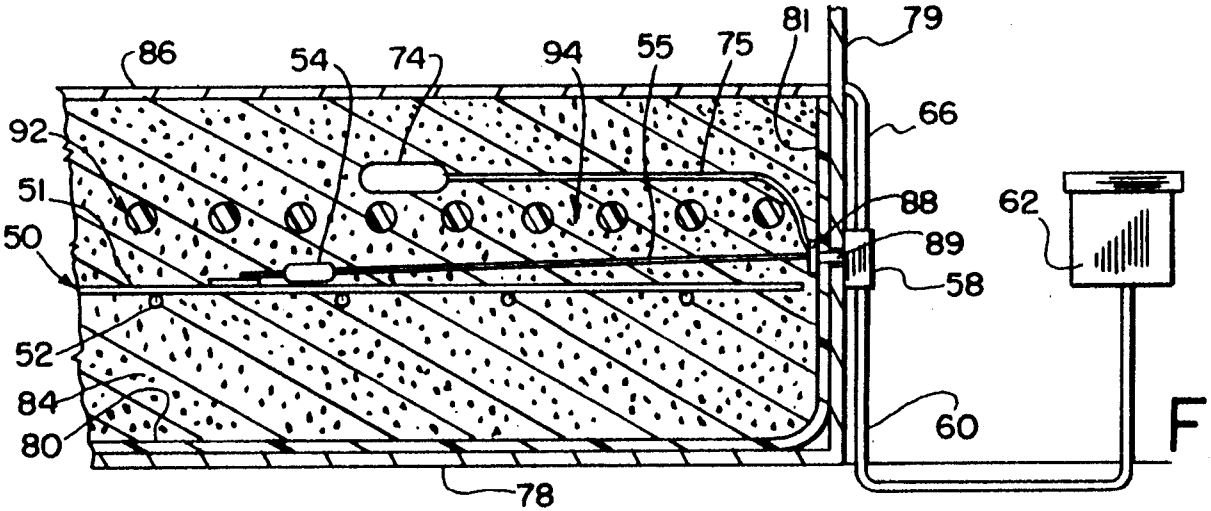
FIG. 3 is a view similar to FIG. 1 of an installation for a double bottom or rebuilt tank.

In FIG. 3, there is illustrated a cathodic protection system for a reconstructed or double-bottom tank. The original tank bottom is indicated at 78 while the tank wall is shown at 79. A secondary containment liner or membrane 80 may extend across the old bottom and along the lower inside of the side wall as indicated at 81. The containment liner is filled with compacted electrolytic backfill indicated at 84 on which the new tank bottom 86 is constructed. The anode 50 may be the same as the anode in FIG. 1 formed of the conductor bars or ribbons 51 and wires 52 in grid or maze fashion and power feed connections 54 being provided between the ribbons and power leads 55.

The power leads extend through grommet 88 and relatively short conduit 89 to junction box 58 positioned outside of the tank wall 79. The junction box is connected through conduit 60 to rectifier 62. A ground lead is provided through conduit 66 from the junction box to the tank.

Positioned within the compacted electrolytic backfill envelope may be a plastic mesh insulator shown generally at 92 positioned directly above the anode. The plastic mesh insulator 92 may be of slightly different construction than the insulator 68 seen in FIGS. 1 and 2. In any event, the plastic mesh insulator is provided with interstices or openings 93 which may be in the shape of squares or diamonds approximately 2"×2", and at least 1" square. The compacted electrolytic backfill fills such interstices 93 as indicated at 94. Reference cells 74 may be provided as illustrated connected to the junction box by leads 75. As seen in FIG. 3, a new tank bottom may rather conveniently be constructed inside an old tank bottom while nonetheless providing the secondary containment finer 80 and a long lived cathodic protection system for the new tank bottom 86.

Figure 2:
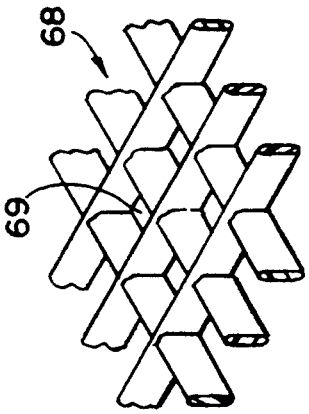
FIG. 2 is a fragmentary perspective view of one form of insulator.
Figure 4:
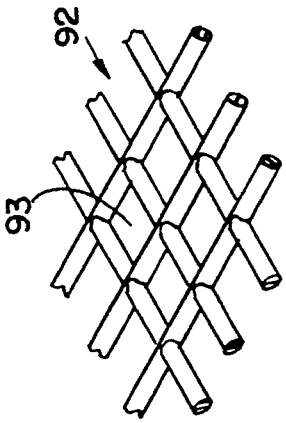
FIG. 4 is a view similar to FIG. 2 of another form of insulator.

With reference to FIGS. 2 and 4, it will be appreciated that either type of plastic mesh reticulate insulator may be used with any installation. The mesh of FIG. 4 may, for example, be made of polyethylene plastic forming a 2"×2" diamond and be formed by 5/15" nominal strands which are heat welded to each other at the junctions providing a ⅜" nominal vertical dimension at such junctions.

The mesh of FIG. 2 may be plastic composite with synthetic geo-textiles and may be the type of material utilized to control earthen embankments and soil erosion. In any event, it is important that the openings provided by the mesh not be so large as to permit wires or ribbons of the anode to project through and contact the tank bottom. The openings also should not be so small that they won't fill with electrolytic backfill to be compacted.

Figure 5:
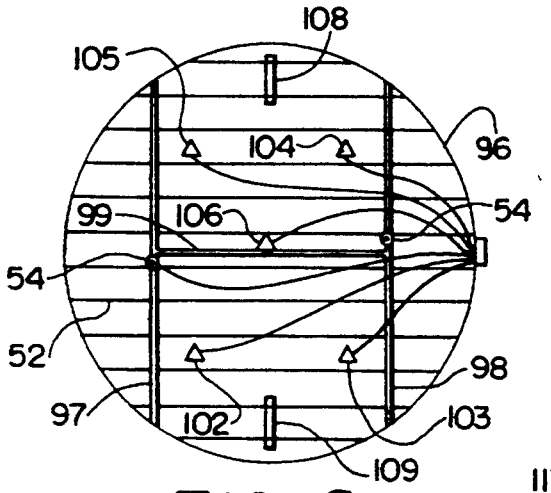
FIG. 5.is a schematic plan illustration of a wire/ribbon fabricated anode using separate parallel wire lengths for a small or medium size tank bottom.

Referring now to FIG. 5, there is illustrated a typical anode layout for a relatively small circular tank bottom 96. The anode includes ribbons 51 positioned along symmetrical major chords indicated at 97 and 98 which are interconnected by distributor ribbon 99 on a diameter. The wires 52 extend at fight angles to the ribbons 97 and 98 on symmetrical major chords and may be spaced on 5 ft. centers, for example. As illustrated, there are two power feed connections 54, one to each of the major chordal ribbons near the intersection with the distributor ribbon 99. The layout of FIG. 5 also includes five zinc, copper sulfate, or other reference cells positioned in the symmetrical arrangement as illustrated at 102, 103, 104, 105 and in the center 106. For the outermost wire, short current distributor ribbons 108 and 109 are provided connecting the outermost wire to the nearest wire which is, in turn, connected to the ribbons on the major chords. Each ribbon/ribbon or wire/ribbon intersection is electrically connected.

Figure 6:
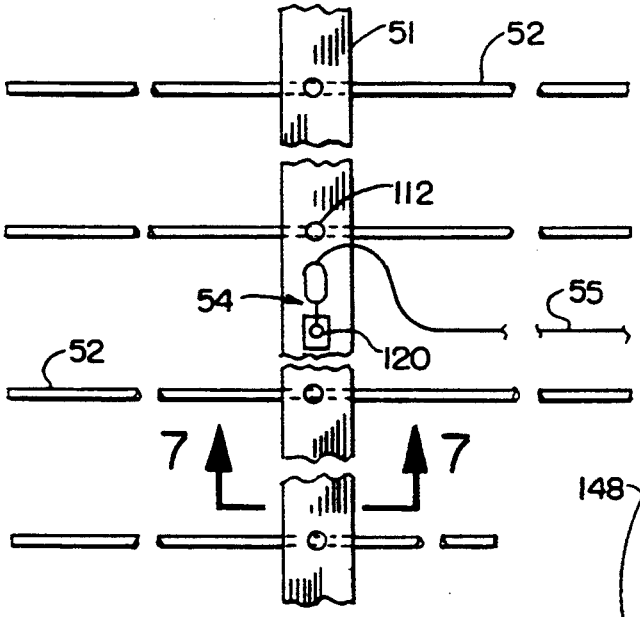
FIG. 6 is an enlargement illustrating one form of how the wires and ribbons may be interconnected.

Referring now to FIG. 6, there is illustrated a conductor bar or ribbon 51 and the fight angle wires 52. A resistance or spot weld is provided at each intersection as seen at 112. FIG. 6 aim illustrates the power feed 55 and the connection 54 to the conductor ribbon 51. Such connection is shown in greater detail in FIG. 10. As seen in such figure, the power feed 55 may be a number eight insulated conductor. The exposed copper strands 114 may be secured by hydraulic compression splicing sleeve 115 to titanium or other valve metal conductor rod 116 which is in turn welded to the flat side of a rectangular conductor plate 117. The rod 116 is parallel to the major flat side of the plate 117. A heat shrink sleeve may be provided as seen at 118. The entire joint may be provided with a mastic sealant half lapped over the splice and the entire splice may be encapsulated in epoxy as indicated at 119. The connection to the ribbon 51 is provided by spot welding the plate 117 to the ribbon 51 at the specified location as seen at 120 in FIG. 6. As can be seen from FIGS. 1 and 3, the connection provides an extremely low profile and does not interfere with the placement of the mesh insulator on top of the anode.

Figure 7:
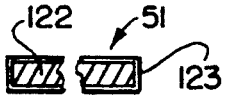
FIG. 7 is an enlarged transverse section of the ribbon.

Referring now additionally to FIG. 7, there is illustrated a cross section of the ribbon 51. The bar, of course, would be similar but somewhat larger. The ribbon has a titanium or other valve metal substrate 122 and may have a coating 123 of either one of the noble metals or of mixed metal oxides. For both the ribbon and the bar, the composition of the substrate is preferably ASTM 265; titanium grade 1. The ribbon is preferably 0.25" in width, 0.025" in thickness and has a weight of 6 lbs. per 500 feet and has a resistance of 0.042 ohms per ft. An anode ribbon with a titanium substrate and with TIR 2000 mixed metal oxide coating, is supplied by Materials Protection Company of Houston, Tex. The ribbons come in 500 ft. reels. Although titanium is the preferred valve metal, as indicated, a number of valve metals may be used. It is preferred that valve metal be selected from the group of titanium, niobium, tantalum, or alloys thereof.

Figure 8:
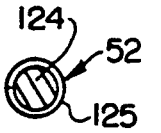
FIG. 8 is an enlarged transverse section of one form of wire.
Figure 9:
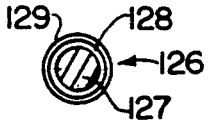
FIG. 9 is a similar section of a copper cored coated valve metal wire.

The two types of useful wire are seen in section in FIGS. 8 and 9. In FIG. 8, there is illustrated a titanium wire 52 having a solid core of titanium indicated at 124 or other such noted suitable metal and a coating 125 of either one of the noble metals or of mixed metal oxides. The wire 126 of FIG. 9 has a copper core seen at 127, a titanium or other such metal cladding 128, and a noble metal or mixed metal oxide coating 129.

The wire with the copper core seen in FIG. 9 has a lower resistance than the solid titanium or other valve metal wire of FIG. 8. This reduces the number of power feeds required which are a high cost part of the design. They are also difficult to fabricate and install, and represent a potential failure point. The wire, particularly the copper cored wire, has increased current capacity so it can be driven harder. Greater current capacity is required on hot tanks where the contents are heated or kept hot. Also, greater current capacity reduces the spacing requirement of the strands of the grid or maze and thus the cost of material.

The wire size or gauge may vary widely. The wire lays flat, or goes around corners more easily and is easier or quicker to roll out and make connections or install. However, wire larger than 0.50" in diameter begins to become difficult to handle and fabricate. A preferred size range is from about 0.025" to about 0.50" in diameter.

The somewhat larger bar may be of the same substrate. The conductor bars are preferably 0.5" in width, 0.040" in thickness, have a weight of 10 lbs. per 250 ft., and have a resistance of 0.013 ohms per ft. Such conductor bars or ribbons are available in 250 ft. coils.

Reference may be had to prior U.S. Pat. Nos. 4,519,886 or 4,331,528, or U.K. Publication 896912, published May 23, 1962, all of which show titanium anodes with either mixed metal oxide coatings or noble metal coatings which may be used with the present invention.

For the permanent reference cells, it is preferred to use two types of reference cells. One type is a zinc reference cell which may be a 1.4"×1.4"×9" electrode, prepackaged in quick wetting backfill. The zinc alloy of the electrode should conform to ASTM B-418-80 Type II.

The other type of reference cell preferred is a copper/copper sulfate reference cell which is constructed of a 2" diameter by 8" long schedule 80 PVC pipe with an ion trap on one end to prevent contamination. The electrode has a long design life and stability of + or −5 millivolts under 3.0 microamp load. It is shipped with a cloth sack with special backfill. The leads 75 to the permanent reference electrode are insulated with a high molecular weight polyethylene insulation and the leads should be of sufficient length to extend to the junction box 58 without splicing.

Figure 11:
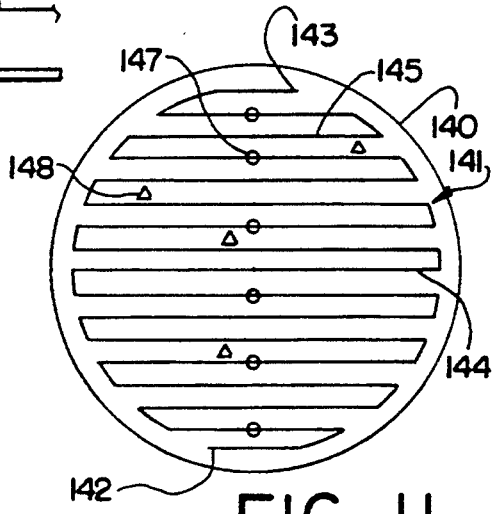
FIG. 11 is a schematic illustration of a wire only anode for a medium size tank formed into a maze without cutting the wire.

Referring now to FIG. 11, there is illustrated a medium size circular tank bottom indicated at 140 with the anode being shown generally at 141 which is in the form of a wire maze formed by a continuous length of wire, one end of which is seen at 142, while the opposite end is at 143. The maze is formed of a series of dead end loops indicated at 144 with the majority of the wire being laid on parallel chords seen at 145, such chords being equally spaced from each other. The several power feed connections are indicated schematically by the circles seen at 147 while the reference cells may be positioned as indicated by the triangular symbols 148. The power feeds may be connected directly to the wire by suitable Y-connections as hereinafter described. Again, a designed system intentionally has redundant power feed connections and reference cells.

Figure 12:
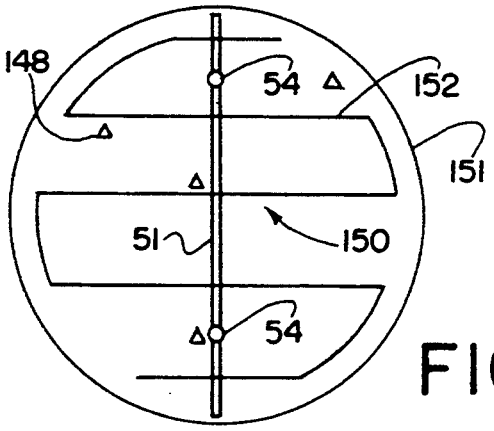
FIG. 12 is a wire/ribbon anode using a single diametral ribbon.

In FIG. 12, there is illustrated a wire/ribbon anode shown generally at 150 for a somewhat smaller circular tank bottom 151. The anode comprises a single length of wire 152 in maze form which loops back and forth crossing the single diametral ribbon 51 on substantially equal centers at which the ribbon and wire are electrically interconnected. Two power feeds are provided to the ribbon indicated at 54 while redundant reference cells are provided at the triangular symbols 148.

Figure 13:
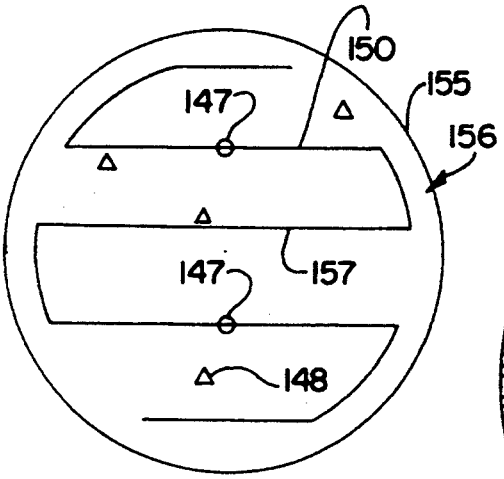
FIG. 13 is an anode similar to FIG. 12, but without the diametral ribbon.

Referring now to FIG. 13, there is also illustrated a rather small circular tank bottom 155 with the anode 156 being comprised of a single length of wire 157 formed into a maze which again includes parallel substantially equally spaced chordal sections 158. There are two power feed connections 147 and four reference cells 148 as illustrated. Accordingly, it can be seen that the anode of FIG. 13 is very similar to the anode of FIG. 12, but does not use the diametral ribbon.

Figure 14:
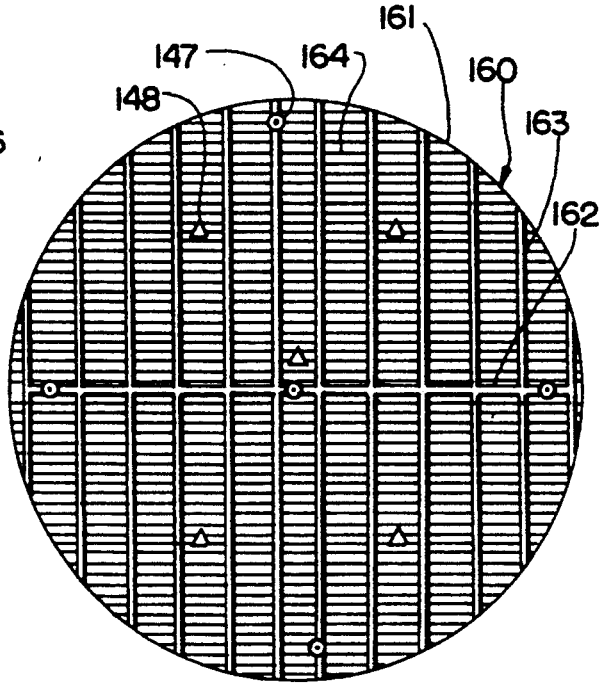
FIG. 14 is a wire/ribbon anode using a large number of ribbons extending primarily in one direction with electrically interconnected wire sections extending normal to that direction.

In FIG. 14, there is illustrated a wire/ribbon anode shown generally at 160 for a relatively large circular tank bottom 161. The anode comprises one diametral bar or ribbon indicated at 162 with a series of chordal ribbons or bars indicated at 163 crossing the bar 162 on substantially equal centers and extending normal thereto. Sections of wire indicated at 164 extend parallel to each other and thus parallel to the diametral ribbon or bar 162 crossing the chordal ribbons 163, again on substantially equal centers. The crossing ribbons or bars are electrically interconnected to each other as are the crossing wires and ribbons, thus to form a rather substantial reticulate grid formed of the wires, ribbons and bars. Electrical connections to the power feeds are provided at 147 in at least five different locations, while the reference cells 148 are positioned in also at least five different locations. In this embodiment the parallel ribbons 163 extend primarily in one direction with the electrically interconnected wire sections 164 extending in a direction of normal to such ribbons.

Figure 15:
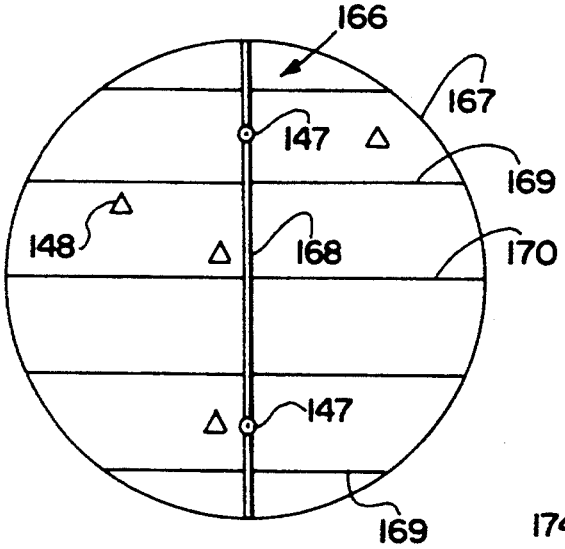
FIG. 15 is a simplified anode using a single diametral ribbon and transverse wire sections.

Referring now to FIG. 15, there is illustrated a relatively simple anode 166, for a relatively small circular tank bottom 167. The anode 166 comprises a single diametral bar or ribbon 168 and sections of wire indicated at 169 extending normal thereto. The section of wire 170 in the middle is also on a diameter and each section of wire is electrically connected to the ribbon 168. Two power feed connections are provided at 147 to the ribbon and four different reference cells are provided as illustrated by the triangular symbols 148.

Figure 16:
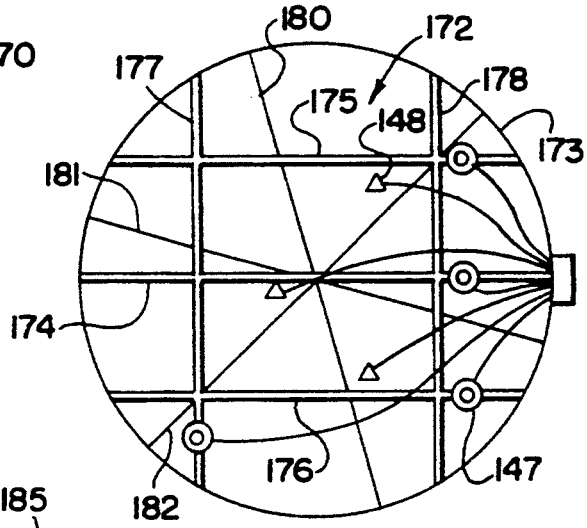
FIG. 16 is an anode using a symmetrical grid of ribbons and diametral wires each extending through the center.

In FIG. 16, there is illustrated an anode 172 for a circular tank bottom 173. The anode comprises a diametral ribbon 174, parallel chordal ribbons 175 and 176, and perpendicular chordal ribbons 177 and 178. Traversing such ribbon network are three diametral wire sections indicated at 180, 181 and 182. The ribbons and wires are electrically interconnected where they cross. As illustrated, there may be four power feeds to the ribbons as seen at 147 and three different reference cells 148.

Figure 17:
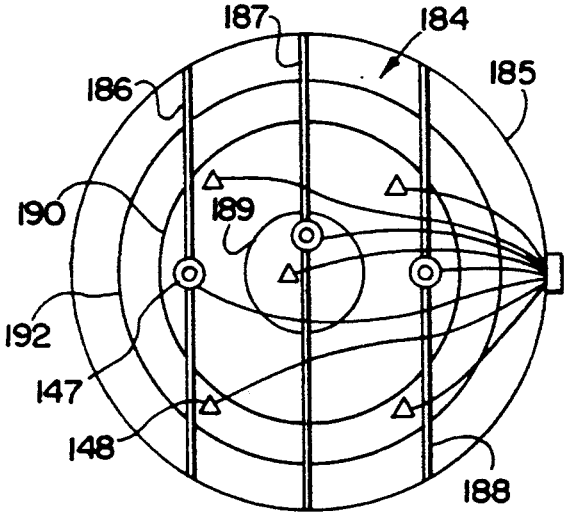
FIG. 17 is an anode using chordal or diametral ribbon and concentric circles of wire.

Referring now to FIG. 17, there is illustrated an anode 184 for a circular tank bottom 185. The anode 184 comprises parallel ribbons 186, 187, and 188, with the center ribbon 187 being on a diameter. Connected to the such ribbons are three circular wire sections seen at 189, 190, and 192. Such wire sections are concentric with the tank bottom and it is noted that they are not equally radially spaced. The circular sections closer to the circumference of the tank are more closely spaced. A power feed connection is supplied to each ribbon as indicated at 147 and four reference cells are provided as illustrated at 148.

Figure 18:
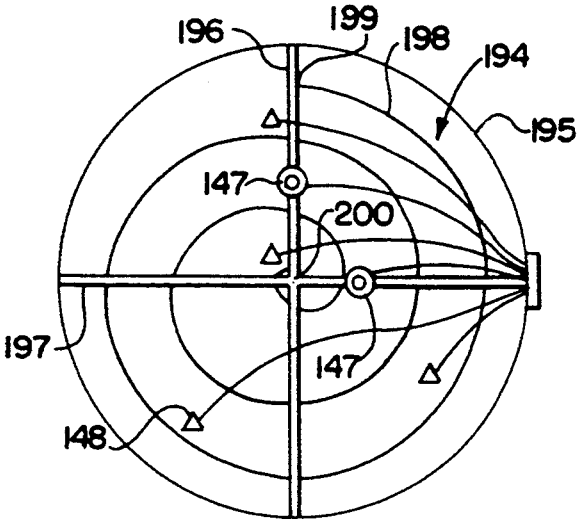
FIG. 18 is an anode using normal diametral ribbon and a continuous wire spiral

Referring now to FIG. 18, there is illustrated an anode 194 for a circular tank bottom 195. The anode comprises normal diametral ribbons 196 and 197 and a single length of wire indicated at 198 formed in a spiral. The spiral is connected at one end near the circumference of the tank at 199 to the ribbon 196. The opposite end of the spiral is connected near the center of the tank as indicated at 200. Two power feed connections are provided as indicated at 147 to each of the ribbons, and again, a plurality of reference cells are arranged as indicated at 148.

Figure 19:
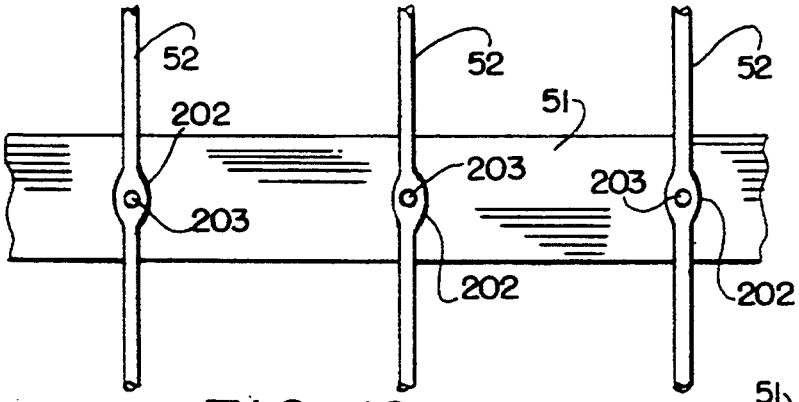
FIG. 19 illustrates another form of weld connection between wire and ribbon.

In FIG. 19, there is illustrated a section of ribbon 51 which is crossed by three equally spaced wires 52. Each wire includes a flattened section seen at 202 with a tack weld 203 in the center thereof. The wire 52 may readily be flattened by peening with a hammer, for example, or by a hand or hydraulic press. Wires may also be tack welded to each other in the same manner.

Figure 20:
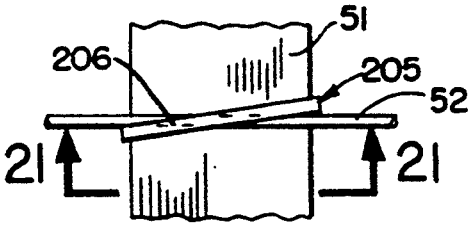
FIG. 20 is a fragmentary top plan view of one form of mechanical ribbon/wire connection.
Figure 21:
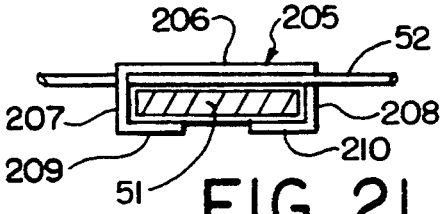
FIG. 21 is a section taken from the line 21—21 of FIG. 20.

In FIGS. 20 and 21, there is illustrated a mechanical ribbon/wire connection which is the form a brass or other suitable conductive metal staple or clinch 205. The clinch includes a back 206 which goes over the top of the wire spanning a major flat surface of the ribbon 51, two legs 208 and 209 which are clinched around the opposite side of the ribbon as seen at 209 and 210. Because the wire has to clear the legs 207 and 208, the clinch or staple will extend at a slight angle to the wire as is apparent in FIG. 20.

Figure 22:
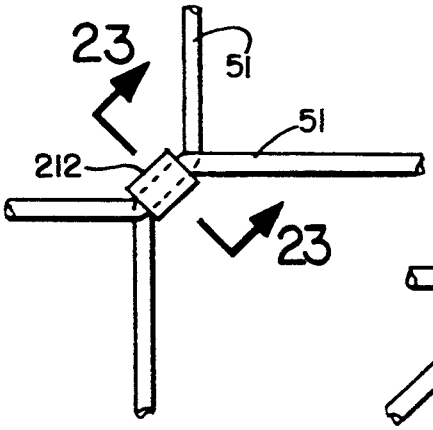
FIG. 22 is a fragmentary wire-to-wire connection using a crimp sleeve.
Figure 23:
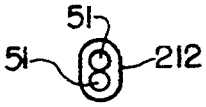
FIG. 23 is a section of the mechanical splice of FIG. 22 seen from the line 23—23 thereof.

In FIGS. 22–25, there are illustrated several wire-to-wire mechanical connections utilizing one or more crimped sleeves 212. In FIG. 22, there is illustrated a crossing or X-connection utilizing a single crimped sleeve 212. Because the crimped sleeves hold the wires parallel and abutting for a short distance, they are slightly offset as they pass through the crimped sleeve. Thus, the wire strand at the bottom in FIG. 22 is a continuation of the wire strand at the top. Conversely, the wire strand at the right is a continuation of the wire strand at the left. FIG. 23 illustrates the crimped sleeve in section and the two adjacent wires at the connection.

Figure 10:
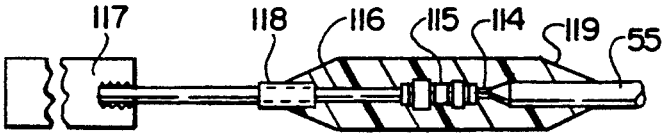
FIG. 10 is an illustration of a power feed/ribbon connection.
Figure 24:
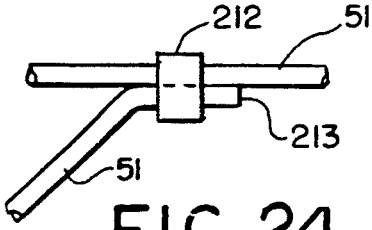
FIG. 24 is a fragmentary wire-to-wire Y connection.

FIG. 24 illustrates what is known as a Y-connection with one wire section terminating at 213 and extending at an acute angle with respect to the other wire section. In this connection a single crimped sleeve 212 is employed. Additional crimped sleeves may be utilized. If the angle wire section is a power feed, the entire connection including the insulation of the power feed will be encapsulated as seen in FIG. 10.

Figure 25:
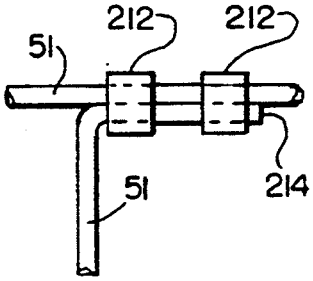
FIG. 25 is a view of a hand tool for forming such mechanical connections.

In FIG. 25, there is illustrated what may be termed an L-connection utilizing two crimped sleeves 212 fairly close to each other with one wire terminating at 214. The terminating wire extends at a substantially fight angle to the other wire.

Figure 26:
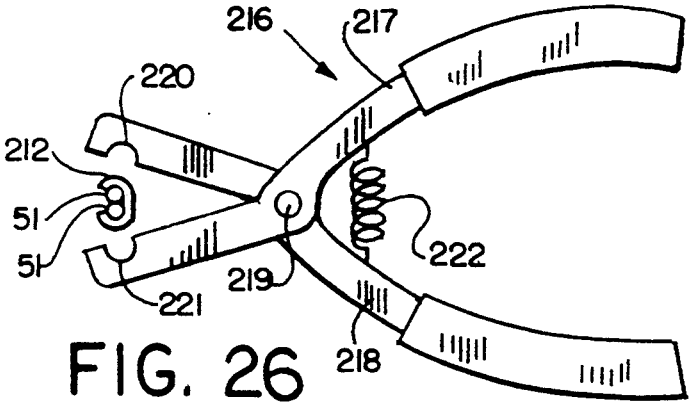
FIG. 26 is a fragmentary wire-to-wire L connection using two sleeves.

In FIG. 26, there is illustrated a hand tool shown generally at 216 for forming the crimped connection. As illustrated, the tool 216 includes handles 217 and 218 pivoted at 219. The continuation beyond the pivot forms facing semi-circular jaws 220 and 221. The handles are held apart by spring 222. The crimped sleeve 212 is initially in the form of an open C and the wires 51 may be positioned within the C side-by-side. The tool is then closed on the partially open crimp sleeve and the sleeve is closed by the pressure of the jaws. The crimp sleeve is formed of a relatively soft cold flowable electrically conductive material such as brass, aluminum, copper or alloys thereof.

It will be appreciated that other types of mechanical connections may be employed, such as screw clamps of the type sold under the trademark BURNDY. Whatever mechanical connection is employed, it is preferred that the connection be tinned or brazed to provide a good electrical connection. It may also be coated.

Figure 27:
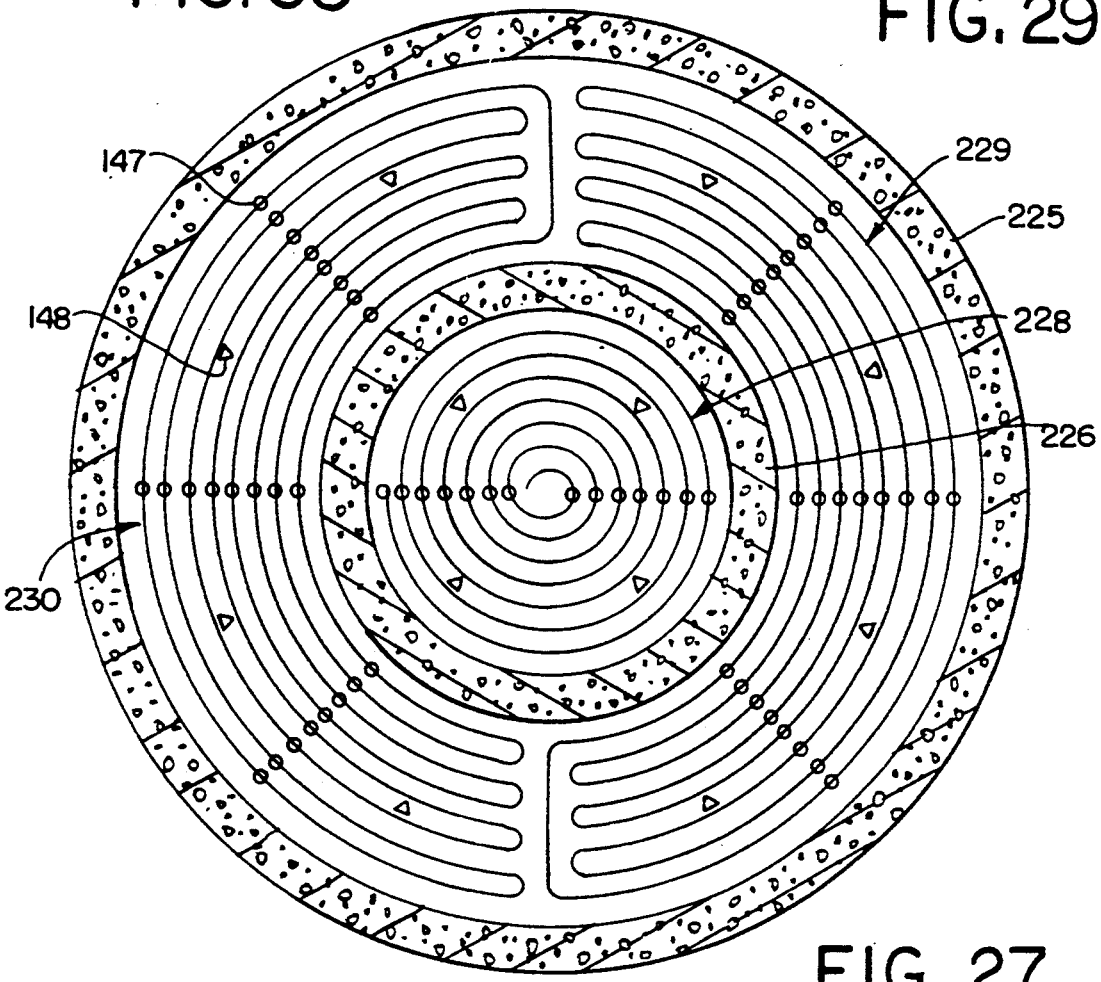

Referring now to FIG. 27, there is illustrated an anode system for a relatively large circular tank bottom which includes two concentric ring walls seen at 225 and 226. The anode system illustrated comprises three separate wire mazes. The maze in the center of the tank is in the form of a spiral indicated at 228. Between the two ring walls, there are two semi-circular mazes indicated at 229 and 230, each formed of a continuous wire. Again, depending upon the size of the tank, there may be a plurality of power feed connections indicated at 147, and also a redundancy of reference cells indicated at 148. It is noted that the power feed connections are provided on substantially diametral or radial paths, and in this manner, there may be more than one junction box on the exterior of the external ring wall connecting such power feeds to the rectifier. Again, a wide variety of grids, patterns or mazes may be employed utilizing the wire alone, or a wire/ribbon combination.

Figure 28:
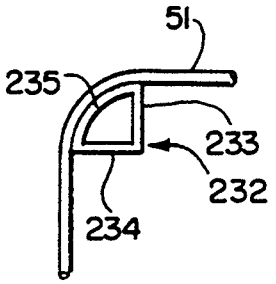
FIG. 28 is an illustration of a jig which may be used for forming a radiused right angle bend in the wire.
Figure 29:
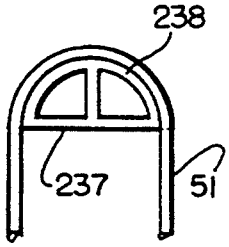
FIG. 29 is a similar jig shown forming a 180° bend.

Since the wire, whether copper cored or solid titanium or other such valve metal is relatively dead, it may be readily be formed into various bends or curves with the aid of templets or jigs as seen in FIGS. 28 and 29. Once such formed, it will remain in the bent configuration. In FIG. 28, them is illustrated a jig 232 for forming the wire 51 in a 90° bend. The jig simply comprises perpendicular legs 233 and 234 interconnected by a circular section 235 which is provided with a wire receiving outwardly opening groove. Thus, the wire by hand manipulation with the aid of the templet can readily be formed into the right angle radiused bend illustrated.

In FIG. 29, there is illustrated a 180° jig 237 which has a circular grooved section 238 permitting the formation of the curved U-shape bend illustrated. A wide variety of other guides or jigs may be fabricated and employed to facilitate the bending of the wire to the desired configuration.

Figure 30:
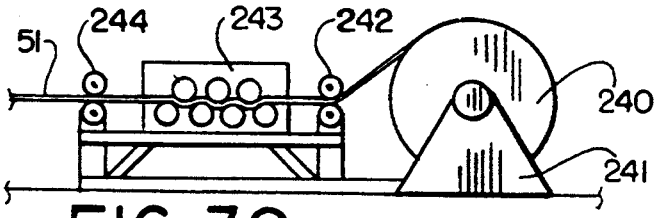
FIG. 30 is a schematic illustration of a field straightener which may be used, at a shop or the construction site, with a spool of anode wire.

Referring now to FIG. 30, it will be appreciated that the wire is normally supplied in spools illustrated at 240. The wire may be mounted on an uncoiler stand 241, either at a shop of in the field. The wire 51 is then drawn through a roll set 242, straightener 243, and exit roll set 244. The straightener works the wire to remove any set or memory of curvature resulting from the coiling of the wire and which enables the wire to lay fiat more readily. After the wire is drawn from the straightener, it may readily be cut to length or fabricated into the anode configuration desired. The ribbon and bar may be drawn from spools in the same manner.

For larger size wire, hydraulic or two-handed cutters or crimping tools may be employed to form the mechanical connection or to sever the wire.

INSTALLATION

The cathodic protection system is installed after the tank erection contractor has constructed the ring wall in the case of a new tank in FIG. 1, and in any event, placed the secondary containment liner in position, either within the ring wall or within the old tank bottom, and compacted 1 to 4 inches of electrolytic backfill above the liner. The top of the 1 to 4 inch layer of compacted electrolytic backfill provides a working surface on which to construct the anode.

Initially, the anode ribbon or wire is unrolled from the spools at the spacing shown or specified. The wire may be pulled through straightener roll sets as illustrated and may be held in place with electrolytic backfill bags as required to keep the wire from rising above the top of the compacted electrolytic backfill. When the wires are in place in the proper uniform parallelism or pattern, the ribbon may be uncoiled and positioned in the proper locations at right angles to the wire. Each ribbon and wire intersection is then resistance welded or mechanically electrically connected. Each weld or mechanical connection should be checked carefully to insure that it is proper and secure providing a good electrical connection between the intersecting parts.

The power feed connectors may be prefabricated and they are connected to the ribbon at the locations specified. Each power feed conductor is routed through the conduit in the ring wall or the grommet in the rebuilt tank as the case may be.

After the anode grid or maze is constructed on the intermediate layer of compacted electrolytic backfill, the mesh or reticulate plastic insulator may be installed directly above the entire anode. Again, electrolytic backfill bags or weights may be employed to keep the plastic mesh and anode grid from rising above the compacted electrolytic backfill.

The permanent reference cells may be installed at the desired locations. The cloth sack containing the reference cell should be soaked in a container of water for 15–20 minutes and the reference cell may be placed in a hole in the electrolytic backfill surface and the cell is simply backfilled with additional electrolytic backfill to prevent drying. Again, the leads to the reference cells are routed through the ring wall or tank wall to the junction box or boxes. The backfilling of additional electrolytic backfill above the mesh insulator may be accomplished in stages to locate the reference cells where desired, or the reference cells may be positioned beneath the anode grid or maze before the mesh insulator is put in place on the anode.

In any event, the backfilling operation within the ring wall or the old tank is performed by the tank erection contractor and a small track dozer may be employed for placing the electrolytic backfill in the required lifts above the anode wire, conductor bars or ribbons and reference cells. The dozer preferably should have no cleats or if does have cleats, the cleats should not be greater than 2.5". Great care should be exercised during the backfill operations to avoid damage to the anode and wiring. In any event, electrolytic backfill is placed over the reticulate insulator and is compacted and leveled. The compacting not only assures proper compressive loads, but also insures that the electrolytic backfill will fill the openings or interstices in the plastic mesh insulator when employed. Thorough electrical testing should be conducted during the final stages of tank pad construction and if problems occur, remedial action taken.

Resistance measurements between the power feeds should be monitored during the placement of the electrolytic backfill above the cathodic protection anode and reference cells. These measurements should be supplemented by additional resistance and/or potential readings between the reference cells and power feeds. Abrupt increases in resistance indicate damage to the system components during pad construction. At that point, repair should be promptly undertaken. I any event, when the pad of compacted electrolytic backfill is completed and leveled, the construction of the tank bottom may commence.

The system may be commissioned by taking native state tank-to-soil measurements to be recorded. The rectifier unit then will be energized and sufficient time for polarization of the tank bottom will be allowed. Final adjustments to the system will be made when the tank is at least partially filled with product. The criterion for adjustment may be a 100 millivolt polarization shift, or other recognized standard.

It should be noted that the system avoids utilization of highly conductive carbonaceous backfill materials which are employed normally to cause most conventional cathodic protection anodes to function properly. The cathodic protection system of the present invention with its redundant power feeds and reference cells provides a long service life at reasonable cost.

We claim:

1. In combination, an above-ground storage tank having a metal bottom, a leak containing dielectric safety membrane spaced a short distance below and extending beneath the tank bottom generally parallel thereto, a compacted electrolytic backfill positioned between the membrane and the tank bottom supporting the tank bottom, a horizontally disposed cathodic protection anode between the membrane and tank bottom, said anode being in the form of a wire grid or maze, and a mesh dielectric insulator embedded in the electrolytic backfill and positioned between the anode and tank bottom operable to keep any portion of the anode from contacting the tank bottom and to maintain a generally uniform spacing between the anode and tank bottom, said wire being round in transverse section, laterally formable, and being 0.50" or less in diameter.

2. The combination set forth in claim 1 wherein said anode includes conductor ribbons, and the wire of the grid or maze extends generally transversely of said ribbons on uniform centers and is electrically connected to the ribbons.

3. The combination set forth in claim 2 wherein said ribbons and wire are welded to each other.

4. The combination set forth in claim 1 wherein the wire is in the form of concentric circles.

5. The combination set forth in claim 2 wherein the wires of the grid or maze are electrically connected mechanically to said ribbons.

6. The combination set forth in claim 2 wherein the wires of the grid or maze are electrically connected by welding to said ribbons.

7. The combination set forth in claim 1 wherein the wire is in the form of parallel chordal sections.

8. The combination as set forth in claim 1 wherein said tank and tank bottom is circular, and the wire is formed as a spiral having a center, the center of said spiral being substantially the center of the circular bottom.

9. The combination as set forth in claim 1 wherein said tank and tank bottom is circular, and the ribbons extend diametrically or radially of the circular tank bottom.

10. The combination set forth in claim 1 wherein said ribbons and wires are formed wholly or partially from a metal selected from the group consisting of titanium, tantalum, or niobium, and at least said wire is coated.

11. The combination set forth in claim 10 including at least one low profile power feed connection to the wire or ribbon.

12. The combination as set forth in claim 11 wherein said power feed connection includes a power feed terminating rod having a projecting end, and a flat plate parallel to and adjacent the projecting end of the rod.

13. The combination set forth in claim 11 including a plurality of power feed connections electrically connecting the ribbons or wires at different locations to a rectifier.

14. The combination set forth in claim 1 wherein said wire is in the form of titanium clad copper wire with a mixed metal oxide coating.

15. In combination, an above-ground storage tank having a metal bottom, a safety membrane spaced a short distance below and extending parallel to and beneath the bottom to provide a narrow envelope, a compacted electrolytic backfill within said envelope supporting said tank bottom, a horizontally disposed cathodic protection anode positioned between the tank bottom and membrane within said electrolytic backfill, said anode comprising at least one valve metal electrically connected conductor ribbon, and coated valve metal anode wire of smaller cross section extending transversely of and connected to said ribbon, said ribbon and wire forming a substantially uniform grid or maze extending beneath said tank bottom, and a plurality of power feed connections to said ribbon or wire positioned to provide a minimal cathodic protection current uniformly from the anode to the entire tank bottom said wire being round in transverse section, laterally formable, and being 0.50" or less in diameter.

16. The combination set forth in claim 15 including means positioned between the anode and tank bottom to preclude shorting contact between the anode and bottom.

17. The combination set forth in claim 16 wherein said last mentioned means comprises a layer of dielectric mesh insulator having openings accommodating compacted electrolytic backfill to permit current flow through such openings.

18. The combination set forth in claim 17 wherein said insulator is formed of overlapping and heat welded polyethylene strands.

19. The combination set forth in claim 18 wherein each opening is at least one inch square.

20. The combination set forth in claim 15 wherein said wire is formed wholly or partially from a valve metal selected from the group consisting of titanium, tantalum, or niobium.

21. The combination set forth in claim 15 wherein said wire extends substantially transversely of said ribbon on substantially uniform centers and is electrically connected to the ribbon.

22. The combination set forth in claim 15 wherein said wires are arranged to form diameters or major chords of a circular tank bottom.

23. The combination set forth in claim 22 wherein said bars and wire are welded to each other.

24. The combination set forth in claim 15 wherein the wire is in the form of concentric circles.

25. The combination as set forth in claim 15 wherein said tank and tank bottom is circular, and the wire is formed as a spiral having a center, the center of said spiral substantially the center of the circular tank bottom.

26. The combination as set forth in claim 15 wherein said tank and tank bottom is circular, and the wire extends diametrically or radially of the circular tank bottom.

27. The combination set forth in claim 15 including at least one low profile power feed connection to the ribbon or wire.

28. The combination set forth in claim 27 wherein said power feed connection includes a terminating end, and a flat plate secured parallel to and adjacent the end of the power feed and adapted to be secured to the ribbon.

29. The combination set forth in claim 27 including a plurality of power feeds electrically connecting the ribbons or wire at different locations to a rectifier.

30. The combination set forth in claim 15 wherein said wire is titanium clad copper with a mixed oxide coating.

* * * * *